US008683893B2

(12) United States Patent
Chang

(10) Patent No.: US 8,683,893 B2
(45) Date of Patent: Apr. 1, 2014

(54) RATCHET WRENCH

(76) Inventor: Chih-Min Chang, Changhua County (TW)

( * ) Notice: Subject to any disclaimer, the term of this patent is extended or adjusted under 35 U.S.C. 154(b) by 236 days.

(21) Appl. No.: 13/240,434

(22) Filed: Sep. 22, 2011

(65) Prior Publication Data

US 2013/0074659 A1 Mar. 28, 2013

(51) Int. Cl.
*B25B 13/46* (2006.01)

(52) U.S. Cl.
USPC ..... 81/60; 81/63.1

(58) Field of Classification Search
USPC ..... 81/60–63.2
See application file for complete search history.

(56) References Cited

U.S. PATENT DOCUMENTS

2004/0083857 A1* 5/2004 Chang ..... 81/60
2004/0255725 A1* 12/2004 Chang ..... 81/60
2005/0193871 A1* 9/2005 Hsien ..... 81/60
2008/0250903 A1* 10/2008 Hsieh ..... 81/60
2010/0018356 A1* 1/2010 Hu ..... 81/63.1

* cited by examiner

*Primary Examiner* — David B Thomas
(74) *Attorney, Agent, or Firm* — Browdy and Neimark, PLLC

(57) ABSTRACT

A ratchet wrench includes a main body provided at an end portion thereof with an accommodation, a pawl installed in the accommodation, and a ratchet wheel rotatably installed in the accommodation and engaged with the pawl. The main body has a through hole into which a plug is detachably inserted. The through hole of the main body is provided through a surface of the main body and communicated with the accommodation. Removing the plug from the through hole of the main body enables lubricant or cleaner to be poured through the through hole into and out of the accommodation for lubricating or cleaning the internal parts of the ratchet wrench so as to make the ratchet wheel run more smoothly.

8 Claims, 3 Drawing Sheets

RATCHET WRENCH

BACKGROUND OF THE INVENTION

1. Field of the Invention

The present invention relates generally to a ratchet wrench, and more particularly, to a ratchet wrench that enables the user to conveniently clean the internal parts thereof 2. Description of the Related Art A conventional ratchet wrench is composed of a main body, a ring cap, a ratchet wheel, a pawl and a spring member. The ratchet wheel is rotatably mounted in an accommodation provided at an end portion of the main body, the ring cap is mounted to the end portion for preventing the ratchet wheel from escape from the main body, and the pawl and the spring member are mounted in a lateral portion of the accommodation. The pawl is engaged with the ratchet wheel to allow the ratchet wheel to rotate in a single direction, such as a clockwise direction or a counterclockwise direction.

Generally, the ambient environment of the place where the conventional ratchet is in use may be full of various micro things, such as foreign object, dirt, sand, cutting chip, etc. These micro things may enter the inside of the ratchet wrench to cause unsmooth rotation motion of the ratchet wheel. However, because the ring cap is normally mounted to the end portion of the main body by a C-shaped retainer, which is invisible and hidden inside the end portion of the main body after completion of the assembly of the ratchet wrench, an ordinary user can hardly dismantle the ring cap from the end portion, resulting in that the user can not clean the internal parts of the ratchet wrench. In other words, the ordinary user can not solve the unsmooth rotation problem of the ratchet wheel by herself or himself.

SUMMARY OF THE INVENTION

The present invention has been accomplished in view of the above-noted circumstances. It is therefore the primary objective of the present invention to provide a ratchet wrench, which enables the user to clean the internal parts of the ratchet wrench so as to make the ratchet wheel run more smoothly.

To achieve the above-mentioned objective, the ratchet wrench provided by the present invention comprises a main body provided at an end portion thereof with an accommodation. In the accommodation, a pawl and a rotatable ratchet wheel engaged with the pawl are installed. The ratchet wrench of the present invention is characterized in that the main body includes at least one through hole into which a plug is detachably inserted, and the through hole is provided through a surface of the main body and communicated with the accommodation. By means of this feature of the present invention, when the user feels that the ratchet wheel runs unsmoothly, the user can pour lubricant or cleaner through the through hole into the accommodation after the plug has been removed from the through hole, and then the user can rotate the ratchet wheel to make the toothed portion of the ratchet wheel fully contact the lubricant or the cleaner, and then the user can pour the lubricant or the cleaner out of the ratchet wrench through the through hole, such that the internal parts of the ratchet wrench can be lubricated and the dirt or foreign objects can be removed out of the ratchet wrench along with the lubricant or the cleaner so as to make the ratchet wheel run more smoothly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
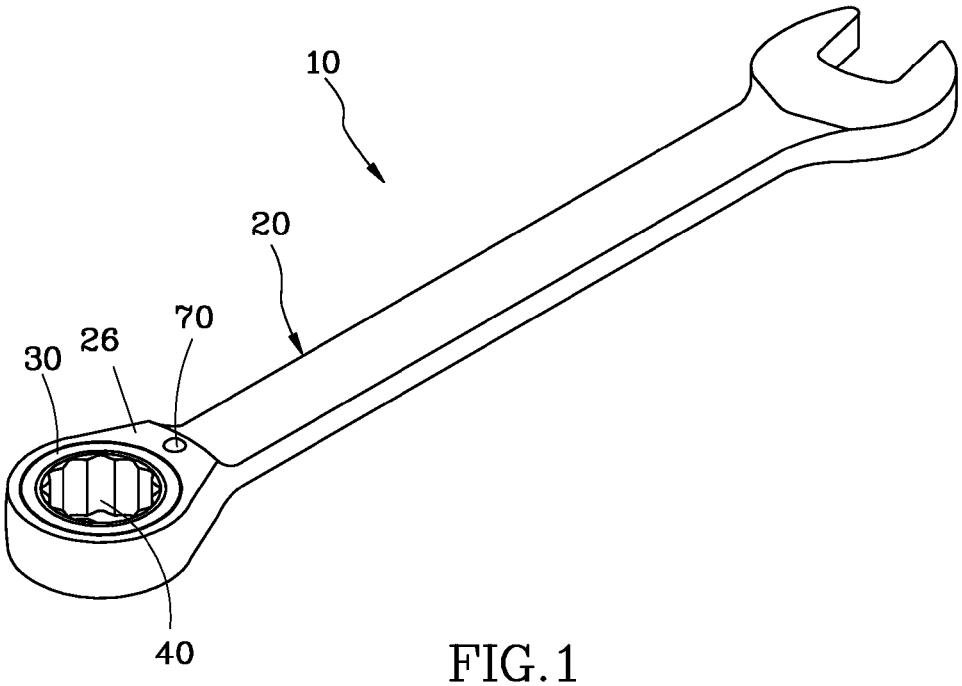
FIG. 1 is a perspective view of a ratchet wrench according to a first preferred embodiment of the present invention.

It is to be mentioned that like reference numerals used in the following preferred embodiments and the appendix drawings designate like elements throughout the specification for the purpose of concise illustration of the present invention.

Figure 2:
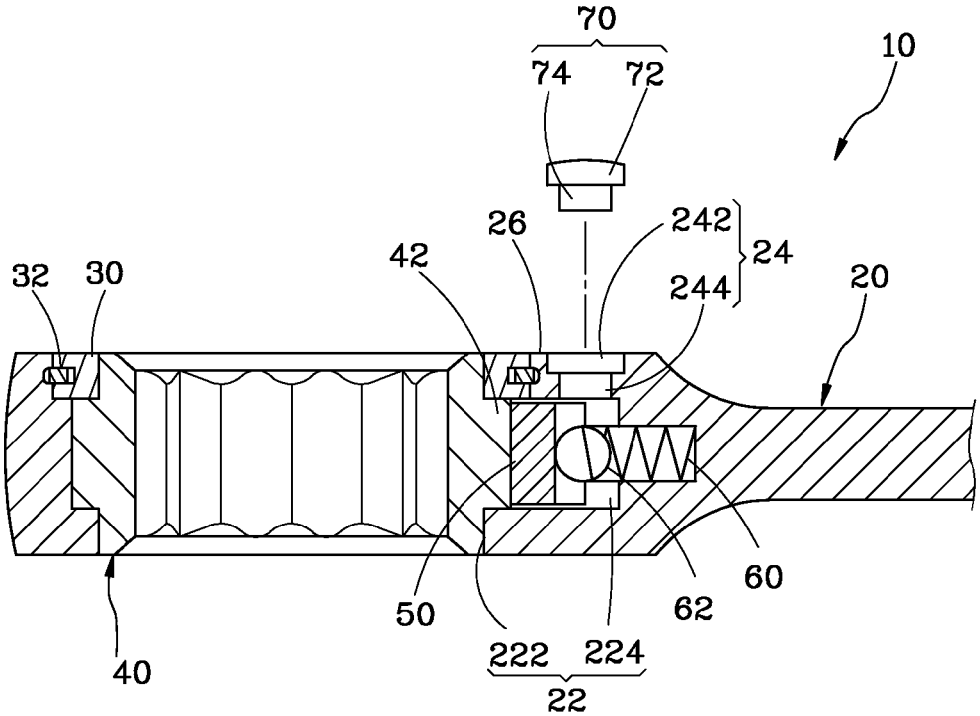
FIG. 2 is a partially cross-sectional view of the ratchet wrench shown in FIG. 1.

Referring to FIGS. 1 and 2, a ratchet wrench 10 provided according to a first preferred embodiment of the present invention comprises a main body 20, a ring cap 30, a ratchet wheel 40, a pawl 50, a spring member 60 and a plug 70.

The structures of and the relationships among the main body 20, the ring cap 30, the ratchet wheel 40, the pawl 50 and the spring member 60 are similar to those of the conventional ratchet wrench. Specifically speaking, the main body 20 is provided at an end portion thereof with an accommodation 22 having a ratchet wheel receiving portion 222 and a pawl receiving portion 224 in communication with the ratchet wheel receiving portion 222. The ratchet wheel 40 is rotatably installed in the ratchet wheel receiving portion 222. By means of a retainer 32, the ring 30 is fixed to the main body 20, such that the ratchet wheel 40 is prohibited from escape from the main body 20. The pawl 50 and the spring member 60 are installed in the pawl receiving portion 224 in such a way that the pawl 50 is engaged with the ratchet wheel 40, and an end of the spring member 60 is stopped at the main body 20 and the other end of the spring member 60 is connected with a steel ball 62 which is stopped at the pawl 50. By means of the pawl 50 that is limited in the specific space of the pawl receiving portion 224, the ratchet wheel 40 is allowed to rotate in a single direction.

The essential technical feature of the present invention lies in that the main body 20 is further provided with a through hole 24 extending through a surface 26 of the main body 20 and communicated with the accommodation 22. In addition, the plug 70 is inserted into the through hole 24 to seal the through hole 24 in normal use. It will be appreciated that the through hole 24 may be designed to be communicated with the ratchet wheel receiving portion 222 though the through hole 24 is configured communicating with the pawl receiving portion 224 in this preferred embodiment of the present invention.

In this preferred embodiment of the present invention, the through hole 24 includes a relatively large diameter section 242 extending form the surface 26 towards the pawl receiving portion 224, and a relatively small diameter section 244 integrally extending from the relatively large diameter section 242 to the pawl receiving portion 224. On the other hand, the plug 70 has a head 72 received in the relatively large diameter section 242 of the through hole 24, and a body 74 received in the relatively small diameter section 244 of the through hole 24. The plug 70 may be made from a resilient material, such as rubber, such that the plug 70 can be tightly fixed in the through hole 24. Alternatively, a metal screw can be used for the plug 70. In this case, the plug 70 is screwingly threaded into the through hole 24. By either way, the plug 70 can tightly block the through hole 24 to prohibit foreign objects from entering into the through hole 24, and the plug 70 can be easily detached from the main body 20 by using user's fingers or a simple hand tool.

Figure 3:
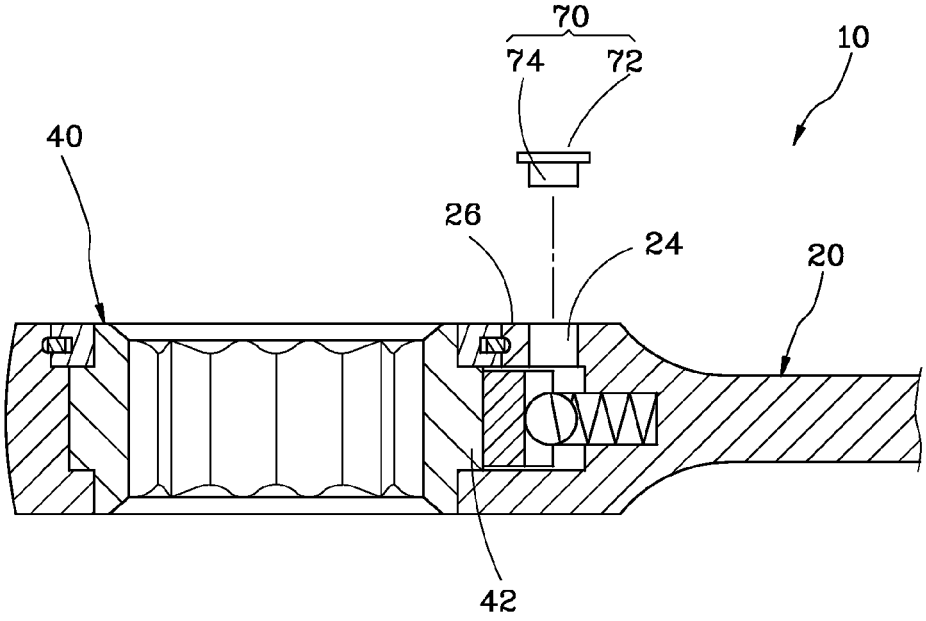
FIG. 3 is a partially cross-sectional view of a ratchet wrench according to a second preferred embodiment of the present invention.

FIG. 3 shows a ratchet wrench 10 according to a second preferred embodiment of the present invention. The difference between the first and second preferred embodiments lies in that the main body 20 of this embodiment is provided with a through hole 24 having a uniform diameter. In addition, the body 74 of the plug 70 is plugged or threaded into the through hole 24, and the head 72 of the plug 70 is abutted against the surface 26 of the main body 20. In this way, the plug 70 of this embodiment can achieve the same effect as the plug 70 of the first preferred embodiment does.

Figure 4:
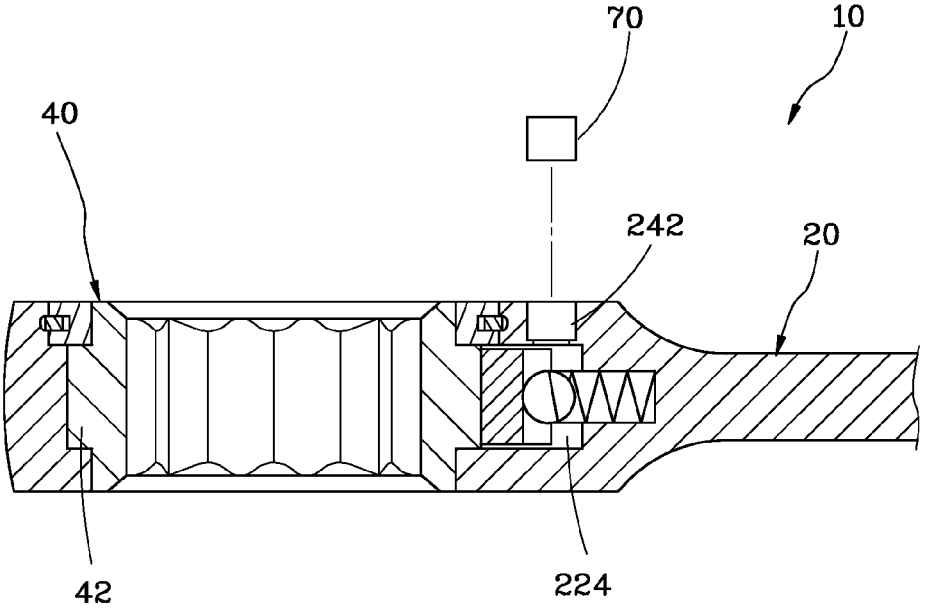
FIG. 4 is a partially cross-sectional view of a ratchet wrench according to a third preferred embodiment of the present invention.

FIG. 4 shows a ratchet wrench 10 according to a third preferred embodiment of the present invention. The difference between this and the first preferred embodiments lies in that the plug 70 in this embodiment has a uniform diameter and the plug 70 is plugged or threaded into the relatively large diameter section 242 of the through hole 24. In this way, the plug 70 of this embodiment can achieve the same effect as the plug 70 of the first preferred embodiment does.

When the user feels that the ratchet wheel 40 of the ratchet wrench 10 disclosed in any preferred embodiments of the present invention runs unsmoothly, the user can firstly remove the plug 70 from the through hole 24 and then pour lubricant or cleaner into the accommodation 22 via the through hole 24 to enable the lubricant or cleaner to flow in between the ratchet wheel 40 and the pawl 50. Thereafter, the user can rotate the ratchet wheel 40 to make the toothed portion 42 of the ratchet wheel 40 fully contact the lubricant or cleaner, and then the user can pour the lubricant or cleaner out of the main body 20 through the through hole 24. By this way, the dirt or foreign objects accumulated in the accommodation 22 can be removed and the internal parts of the ratchet wrench 10 can be lubricated so as to make the ratchet wheel 40 run more smoothly.

Figure 5:
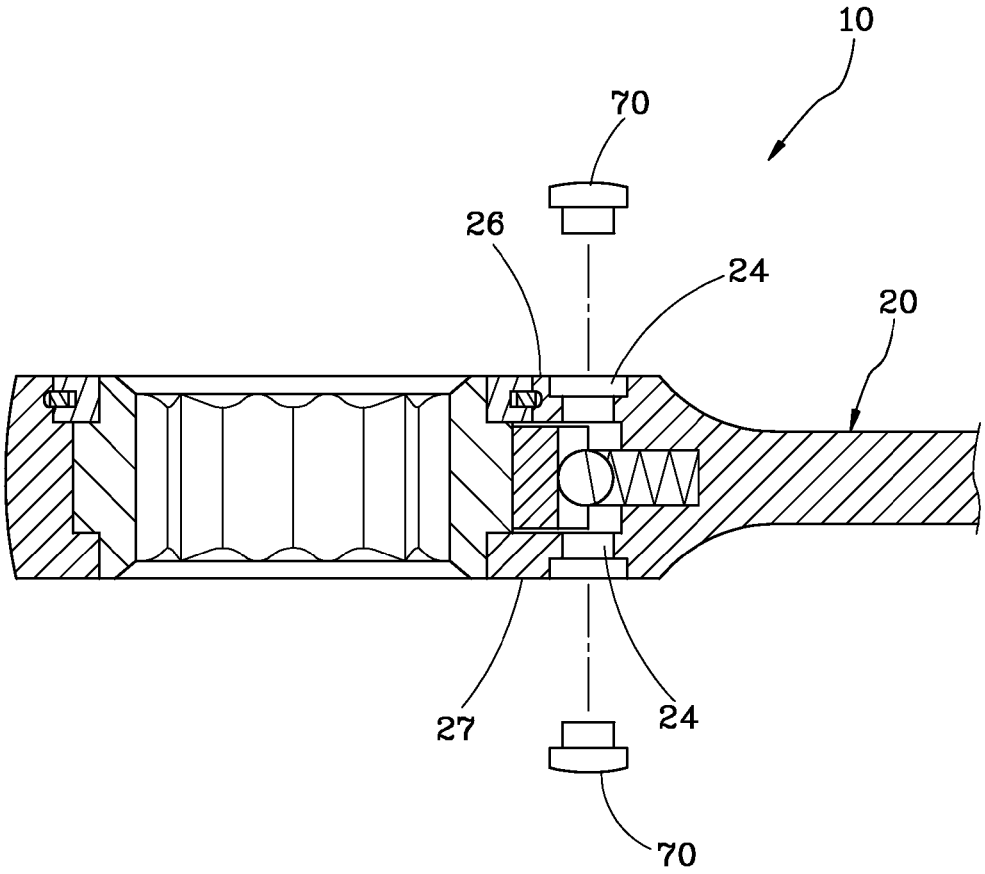
FIG. 5 is a partially cross-sectional view of a ratchet wrench according to a fourth preferred embodiment of the present invention.

FIG. 5 shows a ratchet wrench 10 according to a fourth preferred embodiment of the present invention. The difference between this and the first preferred embodiments lies in that the main body 20 is provided with two through holes 24 extending through two opposite surfaces 26 and 27 of the main body 20 respectively and aligned in a line, and each through hole 24 is inserted with a plug 70.

By this design, when the user pours the lubricant or cleaner into one of the through holes 24 and then rotates the ratchet wheel 40, the lubricant or cleaner can flow out of the main body 20 through the other one of the through holes 24. Alternatively, the user can use an air spray gun to introduce compressed air into the accommodation of the main body 20 through one of the through holes 24, such that the dirt or foreign objects may be exhausted out of the main body 20 along with the compressed air through the other one of the through holes 24. As shown in FIG. 5, the configurations of the two through holes 24 and the plugs 70 are the same as those of the through hole 24 and plug 70 disclosed in the first preferred embodiment of the present invention. However, it will be appreciated that the configurations of the through holes 24 and plugs 70 disclosed in the second and/or third embodiments can also be used in this embodiment. To deserve to be mentioned, the essential technical features of the present invention can not only be applied to the above-mentioned one-way ratchet wrench but also be applied to a switchable two-way ratchet wrench or the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ratchet wrench comprising:

a main body provided at an end portion thereof with an accommodation;

a pawl installed in the accommodation; and a ratchet wheel rotatably installed in the accommodation and engaged with the pawl;

wherein the main body includes at least one through hole into which a plug is detachably inserted; the through hole is provided through a surface of the main body and communicated with the accommodations;

wherein the main body comprises two said through holes and each of the through holes is inserted with one said plug;

wherein the through hole of the main body includes a relatively large diameter section extending from the surface of the main body towards the accommodation, and a relatively small diameter section extending from the relatively large diameter section to the accommodation.

2. The ratchet wrench as claimed in claim 1, wherein the plug includes a head received in the relatively large diameter section of the through hole, and a body received in the relatively small diameter section of the through hole.

3. The ratchet wrench as claimed in claim 1, wherein the plug is received in the relatively large diameter section of the through hole.

4. A ratchet wrench comprising:

a main body provided at an end portion thereof with an accommodation;

a pawl installed in the accommodation; and a ratchet wheel rotatably installed in the accommodation and engaged with the pawl;

wherein the main body includes at least one through hole into which a plug is detachably inserted; the through hole is provided through a surface of the main body and communicated with the accommodation;

wherein the through hole of the main body includes a relatively large diameter section extending from the surface of the main body towards the accommodation, and a relatively small diameter section extending from the relatively large diameter section to the accommodation.

5. The ratchet wrench as claimed in claim 4, wherein the plug includes a head received in the relatively large diameter section of the through hole, and a body received in the relatively small diameter section of the through hole.

6. The ratchet wrench as claimed in claim 4, wherein the plug is received in the relatively large diameter section of the through hole.

7. A ratchet wrench comprising:

a main body provided at an end portion thereof with an accommodation;

a pawl installed in the accommodation; and a ratchet wheel rotatably installed in the accommodation and engaged with the pawl;

wherein the main body includes at least one through hole into which a plug is detachably inserted; the through hole is provided through a surface of the main body and communicated with the accommodation;

wherein the plug includes a head abutted against the surface of the main body, and a body received in the through hole.

8. The ratchet wrench as claimed in claim 7, wherein the main body comprises two said through holes and each of the through holes is inserted with one said plug.

* * * * *